US011219245B2

(12) United States Patent
Liu et al.

(10) Patent No.: US 11,219,245 B2
(45) Date of Patent: Jan. 11, 2022

(54) COTTON-FREE ULTRASONIC ATOMIZER AND ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Yuangang Dai, Hunan (CN); Xinqiang Yin, Hunan (CN); Jianhua Yi, Hunan (CN); Hong Yu, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 401 days.

(21) Appl. No.: 16/306,921

(22) PCT Filed: Dec. 15, 2016

(86) PCT No.: PCT/CN2016/110105

§ 371 (c)(1),
(2) Date: Dec. 4, 2018

(87) PCT Pub. No.: WO2018/000756

PCT Pub. Date: Jan. 4, 2018

(65) Prior Publication Data

US 2019/0183176 A1 Jun. 20, 2019

(30) Foreign Application Priority Data

Jun. 29, 2016 (CN) ..... 201620664475.5

(51) Int. Cl.
*A24F 40/20* (2020.01)
*A24F 40/05* (2020.01)
(Continued)

(52) U.S. Cl.
CPC ..... *A24F 40/05* (2020.01); *A24F 40/40* (2020.01); *A24F 40/485* (2020.01); *B05B 17/0607* (2013.01); *A24F 40/10* (2020.01)

(58) Field of Classification Search
CPC ..... A24F 40/20
See application file for complete search history.

(56) References Cited

U.S. PATENT DOCUMENTS

2007/0283972 A1* 12/2007 Monsees ..... A24D 1/14 131/273
2013/0152922 A1* 6/2013 Benassayag ..... A24D 3/17 128/202.21

(Continued)

FOREIGN PATENT DOCUMENTS

CN 203220994 U 10/2013
CN 204070580 U 1/2015

(Continued)

*Primary Examiner* — Cynthia Szewczyk
(74) *Attorney, Agent, or Firm* — Mauriel Kapouytian Woods LLP; Liang Huang; Michael Mauriel

(57) ABSTRACT

A cotton-free ultrasonic atomizer and electronic cigarette, comprising a tobacco tar cup, an air inlet passage, a tobacco tar smoke outlet passage and an atomization component; the atomization component includes a first atomization piece and a second atomization piece; an atomization cavity is formed between the first atomization piece and the second atomization piece, and an ejection end of the first atomization piece aligns to an atomization surface of the second atomization piece; the first atomization piece communicates with a tobacco tar outlet of the tobacco tar cup, the air inlet passage communicates with the atomization cavity, and the atomization cavity communicates with the tobacco tar smoke outlet passage.

20 Claims, 8 Drawing Sheets

(51) Int. Cl.

| | |
|---|---|
| ***A24F 40/40*** | (2020.01) |
| ***A24F 40/485*** | (2020.01) |
| ***B05B 17/06*** | (2006.01) |
| *A24F 40/10* | (2020.01) |

(56) References Cited

U.S. PATENT DOCUMENTS

| | | | | |
|---|---|---|---|---|
| 2014/0060528 | A1* | 3/2014 | Liu | A61M 15/06 128/202.21 |
| 2015/0034104 | A1* | 2/2015 | Zhou | A61M 15/06 131/329 |
| 2017/0295846 | A1* | 10/2017 | Liu | A24F 47/008 |

FOREIGN PATENT DOCUMENTS

| | | | |
|---|---|---|---|
| CN | 204169066 | U | 2/2015 |
| CN | 204742639 | U | 11/2015 |
| CN | 105266206 | A | 1/2016 |
| CN | 205143491 | U | 4/2016 |
| CN | 105559150 | A | 5/2016 |
| CN | 105559151 | A | 5/2016 |
| CN | 105876873 | A | 8/2016 |
| CN | 205757212 | U | 12/2016 |
| JP | 2010142737 | A | 7/2010 |

* cited by examiner

COTTON-FREE ULTRASONIC ATOMIZER AND ELECTRONIC CIGARETTE

CROSS REFERENCE TO RELATED APPLICATIONS

This application is a national phase application of international application number PCT/CN2016/110105 filed on Dec. 15, 2016, which claims priority to Chinese application number 201620664475.5 filed on Jun. 29, 2016. The entire contents of these applications are hereby incorporated herein by reference.

TECHNICAL FIELD

The present invention relates to a cotton-free ultrasonic atomizer and electronic cigarette, and belongs to the field of electronic cigarette products.

BACKGROUND ART

The existing high-frequency ultrasonic atomizer mainly depends on tobacco tar guide cotton to guide tobacco tar, the speed of the tobacco tar guide is hard to control, and it is prone to cause the problem that an atomization piece is soaked in the tobacco tar or the supply of the tobacco tar is insufficient, namely the supply speed of tobacco tar is hard to control, resulting in that the high-frequency ultrasonic atomization piece cannot work normally, for example, the atomization piece cannot atomize to produce smoke, and that the optimal atomization effect is hard to be fully played; and even if the speed of tobacco tar control is proper, but the atomized smoke needs to penetrate through the tobacco tar guide cotton to be inhaled by the human body, however, when the smoke passes by the tobacco tar guide cotton, negative effects that the granules are enlarged and that the smoke is weakened are caused; in addition, during continuous smoking, if the atomization piece is subjected to insufficient tobacco tar supply, the cotton burning phenomenon can also be produced easily to affect the taste of the smoke; and meanwhile, the burnt flavor or peculiar smell is produced easily when the tobacco tar guide cotton is burnt drily, and even hazardous substance is generated to harm the body health of the user. Finally, the tobacco tar guide cotton takes away a lot of heat, resulting in such undesirable phenomena that the cigarette body becomes hot, the heat efficiency is low, the start up speed of atomization is low, etc.

In the electronic cigarette, the atomization piece can change the tobacco tar into smoke, and the atomization piece is generally made of piezoelectric ceramic.

The Chinese Patent CN201610145881.5 discloses an electronic cigarette atomizer and electronic cigarette. The atomizer includes a suction nozzle and a tobacco tar cup, and an atomization cavity is provided between the tobacco tar cup and the suction nozzle for connecting the tobacco tar cup and the suction nozzle; the atomization cavity is formed by covering an upper cover on a base; a first heating body is fixed in the atomization cavity; the first heating body is in contact with a tobacco tar storage piece; the tobacco tar storage piece is in contact with a top end of a tobacco tar guide structure located in the tobacco tar cup; and at least one vent hole which communicates with a suction nozzle cavity is provided in the upper cover. When the first heating body works, it atomizes liquid into smoke, at the same time, the air in the atomization cavity is also heated by the first heating body, so that the air in the atomization cavity expand on heating, a cavity with high temperature and high pressure is provided in the atomization cavity at this time, so that the smoke is mixed with the heated air in the atomization cavity, and then the smoke is automatically ejected from a tobacco tar smoke outlet passage; and the taste of the smoke is fine and smooth because the smoke in the atomization cavity is mixed and atomized with the heated air.

The Chinese Patent CN201610160216.3 discloses an ultrasonic atomizer and electronic cigarette, the ultrasonic atomizer includes an atomization piece and a liquid guide structure for importing liquid onto an upper surface of the atomization piece; the liquid guide structure communicates with a liquid storage cavity; the upper surface of the atomization piece communicates with an airflow passage; and the atomization piece includes a piezoelectric ceramic layer and an electric conductor for driving the piezoelectric ceramic layer to vibrate. No micropore needs to be provided in the atomization piece to eject atomized gas, thereby being free of the situation that the atomized gas cannot be ejected because the micropore is blocked by larger particles of the atomized gas, and meanwhile liquid leakage of the atomizer can be better prevented.

The two patents mentioned above are the previous research results of the applicant, but the problems of excessive tobacco tar supply or insufficient tobacco tar supply of the tobacco tar guide cotton still cannot be solved.

CONTENTS OF INVENTION

The present invention aims at providing a cotton-free ultrasonic atomizer and electronic cigarette, the atomizer supplies tobacco tar by spraying by using a first atomization piece and atomizes tobacco tar by using a second atomization piece, and the defect of excessive or insufficient tobacco tar supply of the traditional tobacco tar guide cotton can be overcome by the combination of the first atomization piece and the second atomization piece.

In order to achieve the above objective, the present invention adopts the technical solution as follows:

A cotton-free ultrasonic atomizer includes a tobacco tar cup, an air inlet passage, a tobacco tar smoke outlet passage and an atomization component; the cotton-free ultrasonic atomizer is structurally characterized in that the atomization component includes a first atomization piece and a second atomization piece; an atomization cavity is formed between the first atomization piece and the second atomization piece, and an ejection end of the first atomization piece aligns to an atomization surface of the second atomization piece; the first atomization piece communicates with a tobacco tar outlet of the tobacco tar cup, the air inlet passage communicates with the atomization cavity, and the atomization cavity communicates with the tobacco tar smoke outlet passage; and a hole is provided in the first atomization piece, and the second atomization piece is a solid atomization piece.

Preferably, the hole in the first atomization piece is a micropore.

Therefore, the present invention ejects a certain amount of tobacco tar by using the first atomization piece (an ultrasonic atomization piece to the best) through the micropore to supply the tobacco tar and atomizes a proper amount of tobacco tar by using the second atomization piece, and the supply speed of the tobacco tar of this structure is controllable and is accurate. In addition, the atomizer does not adopt tobacco tar guide cotton for storing or guiding the tobacco tar, so that the phenomenon of cotton burning or tobacco tar submersion caused by insufficient tobacco tar supply or over fast supply speed of tobacco tar can be avoided, and the negative effects caused by tobacco tar guide using the traditional tobacco tar guide cotton can be avoided.

According to the embodiment of the present invention, the present invention can be further optimized, and the technical solution formed after the optimization is as follows:

Preferably, the first atomization piece is used for performing first stage oscillating atomization on the tobacco tar, and the second atomization piece is used for performing second stage oscillating atomization on the tobacco tar.

In two embodiments of the present invention, preferably, the first atomization piece and the second atomization piece are both provided on the inner side of the tobacco tar cup.

As a specific fixing mode, the first atomization piece and the second atomization piece are fixed in a hollow cavity of a silica gel base, and the atomization cavity is formed by enclosure of an inner wall surface of the silica gel base, the first atomization piece and the second atomization piece; and a vent groove hole which communicates with the air inlet passage and a smoke discharge hole which communicates with the tobacco tar smoke outlet passage are provided in a side wall of the silica gel base.

An upper cover is fixed to the top of the tobacco tar cup through an annular upper base, and a suction nozzle is installed on an upper end of the upper cover; a first pipe located in the tobacco tar cup and a second pipe sheathed in the first pipe are installed on a lower end of the upper cover; a gap between the first pipe and the second pipe forms the air inlet passage which communicates with the atomization cavity; a vent hole groove which communicates with the air inlet passage is provided in the side wall of the upper cover; and an inner passage of the second pipe communicates with the suction nozzle to form the tobacco tar smoke outlet passage which communicates with the atomization cavity.

In order to conveniently detach the tobacco tar cup to inject tobacco tar, the upper base is in threaded connection with the upper cover.

Preferably, the bottom end of the first pipe and the bottom end of the second pipe are fixed to a fixing base, the silica gel base is fixed in the fixing base and the silica gel base fixes the first atomization piece and the second atomization piece, and an air inlet hole which communicates with the air inlet passage and a tobacco tar smoke discharge hole which communicates with the tobacco tar smoke outlet passage are provided in the side wall of the fixing base located in the tobacco tar cup.

An outer electrode ring and an inner electrode ring installed on the inner side of the outer electrode ring through an insulating ring are installed on the lower end of the fixing base; a lower base is fixed to the bottom end of the tobacco tar cup, a connection electrode ring is installed on the inner side of the lower base through a connection insulating ring, and the connection electrode ring is in electrical connection with the inner electrode ring; and the inner electrode ring is in electrical connection with the first atomization piece and the second atomization piece through conducting wires respectively.

According to one embodiment of the present invention, the first atomization piece is located above the second atomization piece, the fixing base includes an inner cylinder and an outer cylinder, a tobacco tar inlet hole is provided in an upper part of the wall surface of the outer cylinder, and the tobacco tar inlet hole communicates with an upper end face of the first atomization piece.

According to another embodiment of the present invention, the first atomization piece is located below the second atomization piece, a tobacco tar inlet hole is provided in the side wall of the outer electrode ring, and the tobacco tar inlet hole communicates with a lower end face of the first atomization piece. Therefore, the first atomization piece ejects the tobacco tar smoke to the atomization surface of the second atomization piece, then after the tobacco tar smoke is atomized by the second atomization piece, the large-granule tobacco tar smoke which still exists drops onto the first atomization piece under the action of its gravity so as to be ejected onto the atomization surface of the second atomization piece again by the first atomization piece for third time atomization.

Preferably, the aperture of the first atomization piece is 40-100 μm, more preferably 45-60 μm.

Based on the same inventive concept, the present invention further provides electronic cigarette, including a battery component and an ultrasonic atomizer; and the ultrasonic atomizer is the above-mentioned cotton-free ultrasonic atomizer, and the battery component respectively supplies power for the first atomization piece and the second atomization piece of the cotton-free ultrasonic atomizer.

By means of the above structure, the present invention ejects out the tobacco tar to the surface of the second atomization piece in the shape of mist by using the principle of atomization of the first ultrasonic atomization piece, the smoke ejected out by the first atomization piece belongs to large-granule smoke, instead of the so called smoke produced by atomization by heating up, so the smoke atomized by the micropore cannot achieve the atomization taste of the traditional electronic cigarette, the large-granule tobacco tar still needs to be atomized by the high-frequency ultrasonic atomization pieces into small-granule smoke to achieve the atomization effect of the traditional electronic cigarette, the gas passage is provided at the middle of the two atomization pieces to take away the atomized smoke; and moreover, as the tobacco tar is supplied by the spray of the first atomization piece, the amount of tobacco tar supply can be well controlled, and the consistency of the supply amount per puff is good.

Compared with the prior art, the present invention has the following beneficial effects:

1. The startup speed of atomization is high, the atomization is sufficient, and the smoke amount is large.

| Technical solution | First atomization piece | First atomization piece + heating wire | Second atomization piece | First atomization piece + second atomization piece |
|---|---|---|---|---|
| Startup time | >6 s | >2 s | 0.5 s-1 s | 0.1 s-0.5 s |
| Smoke amount (TPM/PUFF) | <0.3 mg/puff | <1.3 mg/puff | 4.5 mg/puff-8.5 mg/puff | 8.5 mg/puff-15 mg/puff |

Wherein, puff refers to the number of puffs, namely the weight of the atomized tobacco tar within the same time.

It can be seen from the above table that, the technical solution of the present invention, namely "first atomization piece+second atomization piece", has the shortest atomization start up time, the amount of the smoke refers to the weight of the tobacco tar that can be atomized in the unit of puff, namely the combined solution of "first atomization piece+second atomization piece" of the present invention can atomize the largest amount of tobacco tar, and thus the smoke amount is the largest.

2. Compared with the traditional solution of "first atomization piece+heating wire", the atomizer of the present invention has the advantages of high heat efficiency, small heat loss and capability of saving energy and electricity. As the first atomization piece needs the heating wire to heat the tobacco tar, with the rise of the temperature of the tobacco tar, the fluidity is higher, only when the temperature of the tobacco tar rises to a certain temperature (the critical temperature), the first atomization piece can atomize the tobacco tar into the smoke; while in the solution of "first atomization piece+second atomization piece" of the present invention, the first atomization piece quantitatively ejects the tobacco tar onto the second atomization piece in the form of tobacco tar droplets at first, and then the second atomization piece atomizes these tobacco tar droplets into smoke, therefore the atomization is more sufficient, the smoke amount is larger, and better electricity saving and tobacco tar saving effects are realized.

3. No cotton participates in the atomization process, thereby being free of the burnt flavor or peculiar smell, and being purer in taste.

4. As the atomizer of the present invention is always in a cotton-free state, the quality guarantee period of the tobacco tar is longer, and the taste of the smoke is purer.

SPECIFIC MODE FOR CARRYING OUT THE INVENTION

Figure 1:
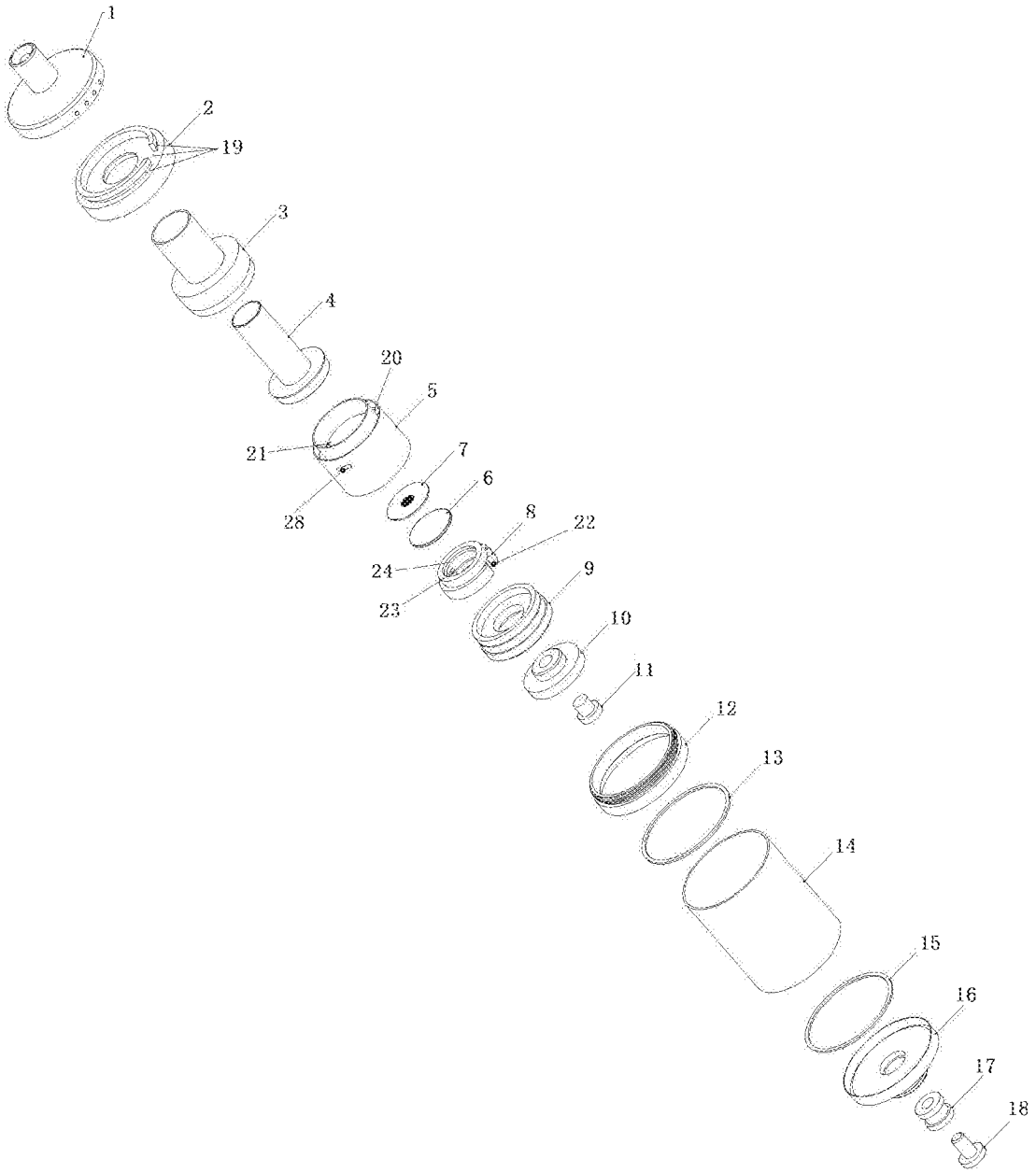
FIG. 1 is an explosive schematic diagram of embodiment 1 of the present invention.

Hereinafter, the present invention will be described in detail with reference to the accompanying drawings and in combination with embodiments. It should be noted that the embodiments in the present invention and the features in the embodiments can be combined with each other without conflicts. For the convenience of illustration, the words "upper", "lower", "left" and "right" appearing in the following text only indicate the upper, lower, left and right directions of the drawing and are not intended to limit the structure.

Embodiment 1

Figure 2:
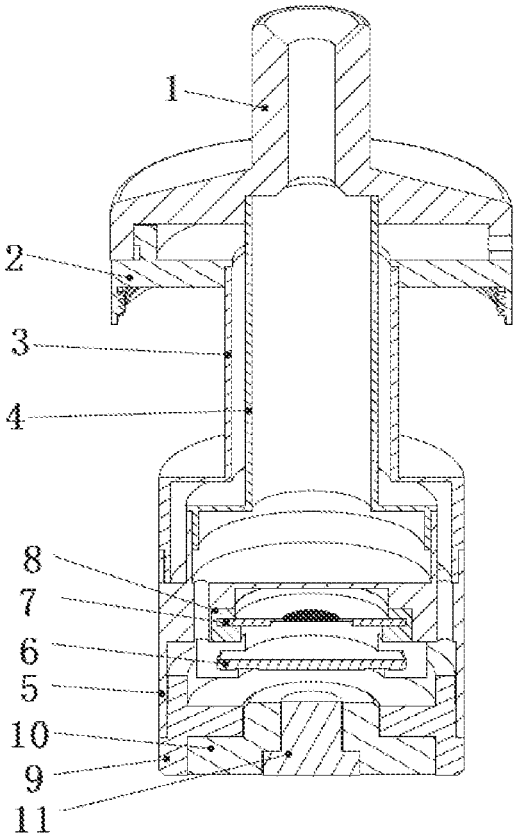
FIG. 2 is a structural schematic diagram of an atomization core in FIG. 1.
Figure 3:
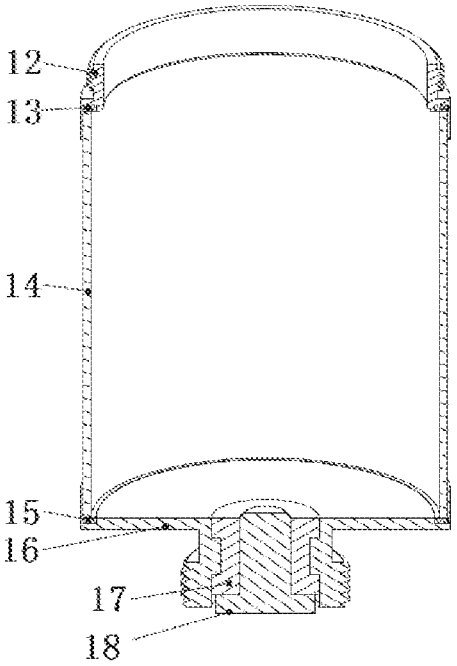
FIG. 3 is a structural schematic diagram of a tobacco tar cup component in FIG. 1.

A cotton-free ultrasonic atomizer, as shown in FIG. 1 to FIG. 3, includes a tobacco tar cup 14, an upper cover 2 is fixed to the top of the tobacco tar cup 14 through an annular upper base 12, and a suction nozzle 1 is installed on the upper cover 2; the upper base 12 is in threaded connection with the upper cover 2, and a sealing ring 13 is provided between the upper base 12 and a top end of the tobacco tar cup 14. A first pipe 3 located in the tobacco tar cup 14 and a second pipe 4 sheathed in the first pipe 3 are installed on a lower end of the upper cover 2; a gap between the first pipe 3 and the second pipe 4 forms an air inlet passage, and a vent hole groove 19 which communicates with the air inlet passage is provided in a side wall of the upper cover 2; and an inner passage of the second pipe 4 communicates with the suction nozzle 1 to form a tobacco tar smoke outlet passage which communicates with the suction nozzle 1.

As shown in FIG. 2 and FIG. 3, the atomization component of the present invention includes a first atomization piece 7 for performing first stage oscillating atomization on tobacco tar and a second atomization piece 6 for performing second stage oscillating atomization on the tobacco tar, wherein the first atomization piece 7 and the second atomization piece 6 are both fixed in a hollow cavity of a silica gel base 8, the silica gel base 8 is of a hollow structure, and a second atomization piece fixing groove 23 and a first atomization piece fixing groove 24 are provided in an inner wall of the silica gel base 8. An inner wall surface of the silica gel base 8, the first atomization piece 7 and the second atomization piece 6 are enclosed to form an atomization cavity. A vent groove hole 22 which communicates with the air inlet passage and a smoke discharge hole which communicates with the tobacco tar smoke outlet passage are provided in the side wall of the silica gel base 8. The upper base 12 is in threaded connection with the upper cover 2. The first atomization piece 7 and the second atomization piece 6 are provided at the central position of the tobacco tar cup 14, the air inlet passage communicates with the atomization cavity, and the atomization cavity communicates with the tobacco tar smoke outlet passage.

An ejection end of the first atomization piece 7 aligns to an atomization surface of the second atomization piece 6; and the first atomization piece 7 communicates with a tobacco tar outlet of the tobacco tar cup 14.

Figure 4:
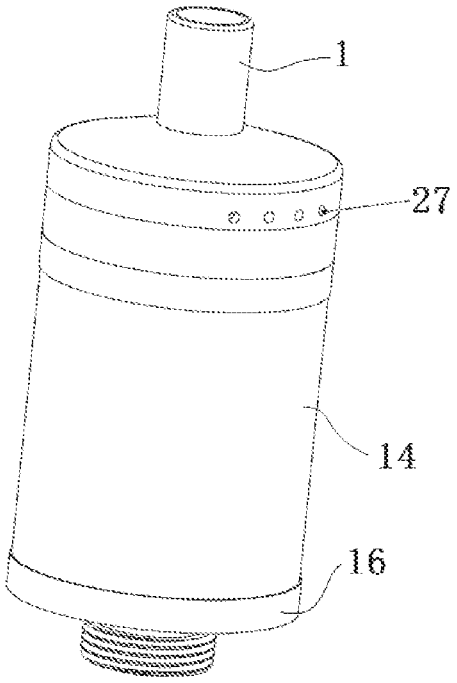
FIG. 4 is an outline view of FIG. 1.

As shown in FIG. 4, an vent 27 which communicates with the vent hole groove 19 of the upper cover 2 is provided in the side wall of the suction nozzle 1.

As shown in FIG. 2, the bottom end of the first pipe 3 and the bottom end of the second pipe 4 are fixed to a fixing base 5, the silica gel base 8 is fixed in the fixing base 5 and the silica gel base 8 fixes the first atomization piece 7 and the second atomization piece 6, and an air inlet hole 20 which communicates with the air inlet passage and a tobacco tar smoke discharge hole 21 which communicates with the tobacco tar smoke outlet passage are provided in the side wall of the fixing base 5 located in the tobacco tar cup 14. An outer electrode ring 9 and an inner electrode ring 11 installed on the inner side of the outer electrode ring 9 through an insulating ring 10 are installed on the lower end of the fixing base 5; and a lower base 16 is fixed to the bottom end of the tobacco tar cup 14, and a sealing ring 15 is provided between the lower base 16 and the bottom end of the tobacco tar cup 14. A connection electrode ring 18 is installed on the inner side of the lower base 16 through a connection insulating ring 17, and the connection electrode ring 18 is in electrical connection with the inner electrode ring 11; and the inner electrode ring 11 is in electrical connection with the first atomization piece 7 and the second atomization piece 6 through conducting wires respectively.

In the present embodiment, the first atomization piece 7 is located above the second atomization piece 6, the fixing base 5 includes an inner cylinder and an outer cylinder, a tobacco tar inlet hole 28 is provided in an upper part of the wall surface of the outer cylinder, and the tobacco tar inlet hole 28 communicates with an upper end face of the first atomization piece 7.

In the present embodiment, the aperture of the first atomization piece 7 is 40-100 μm, oscillating atomization is carried out on tobacco tar 26 by the first atomization piece 7 to form 50-120 μm large-granule tobacco tar smoke, the tobacco tar smoke is ejected to the atomization surface of the high-frequency atomization piece 6, and the high-frequency atomization piece 6 carries out oscillating atomization on the tobacco tar smoke to form 70-130 nm small-granule tobacco tar smoke.

Electronic cigarette includes a battery component and an ultrasonic atomizer; the ultrasonic atomizer is the above-mentioned cotton-free ultrasonic atomizer, and the battery component supplies power to the first atomization piece 7 and the second atomization piece 6 of the cotton-free ultrasonic atomizer respectively.

In the present embodiment, the vibration frequency of the first atomization piece 7 is 100 KHZ-200 KHZ, the second atomization piece 6 is of a solid structure, and its vibration frequency is 1 MHZ-3 MHZ.

The present embodiment has the following advantages:

1. The first ultrasonic atomization piece is used for supplying quantitative small-granule tobacco tar, and then the high-frequency ultrasonic atomization piece is used for atomizing the small-granule tobacco tar.

2. The integrated atomizer is free of cotton structure, free of the burnt flavor and is free of the tobacco tar submersion phenomenon, the problem that the smoke taste is affected or the tobacco tar deteriorates due to the presence of cotton is avoided, the shelf life of the tobacco tar is effectively prolonged, and the smoke taste is purer.

Figure 5:
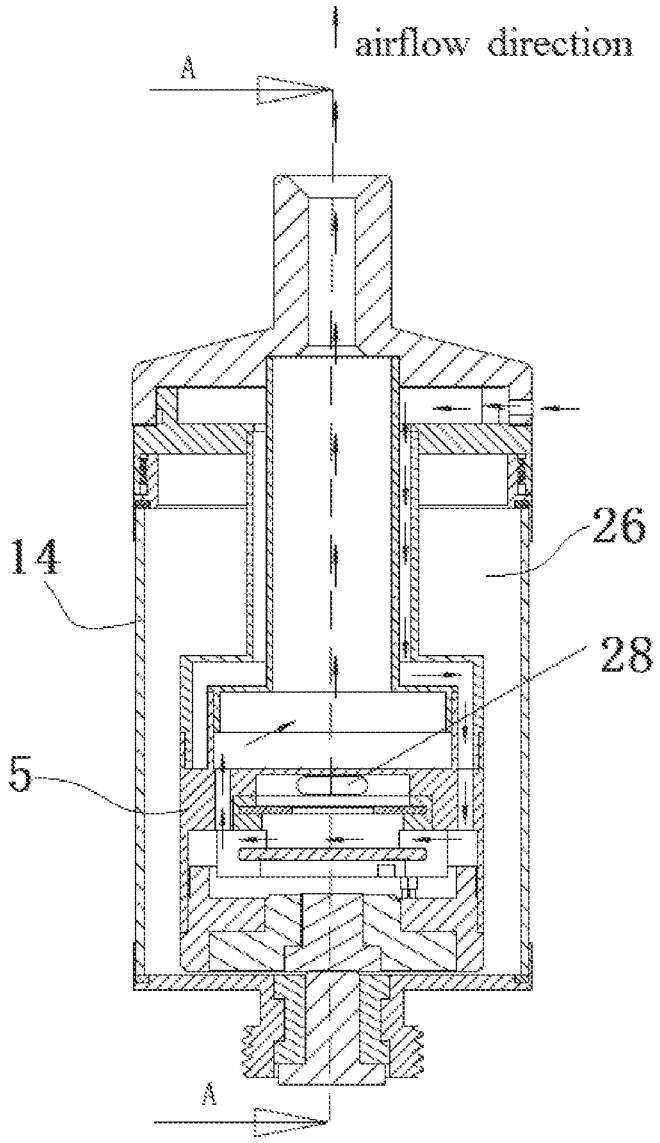
FIG. 5 is a sectional view along an inlet direction in embodiment 1.
Figure 6:
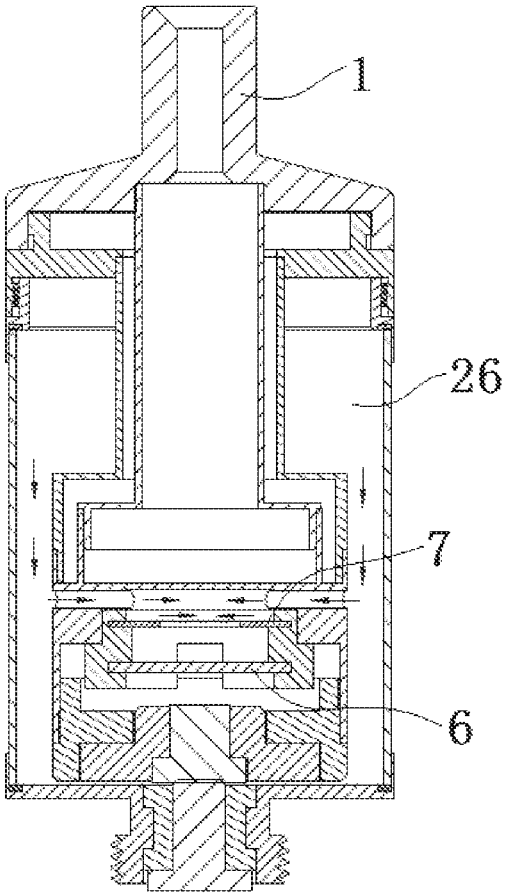
FIG. 6 is an A-A sectional view of FIG. 5.

3. As shown in FIG. 5 and FIG. 6, the two atomization pieces are placed flatwise, the atomization surfaces align to each other, and the first atomization piece is provided on the second atomization piece, which is beneficial for the tobacco tar in the tobacco tar cavity to provide fast tobacco tar supply for the first atomization piece; and the first atomization piece ejects the tobacco tar downwards to the surface of the second atomization piece, and the second atomization piece atomizes the tobacco tar ejected out by the first atomization piece.

4. The airflow enters from the suction nozzle, and then the smoke atomized by the second atomization piece is discharged from the second pipe to be inhaled by the user, and this can prevent the user from inhaling the tiny tobacco tar on the first atomization piece.

5. The atomizer and the battery are locked and extruded by a locking ring with threads to realize contact electric conduction.

6. The suction nozzle is unscrewed to pull out the atomization core, and then the tobacco tar 26 can be injected to the tobacco tar cup.

Embodiment 2

Figure 7:
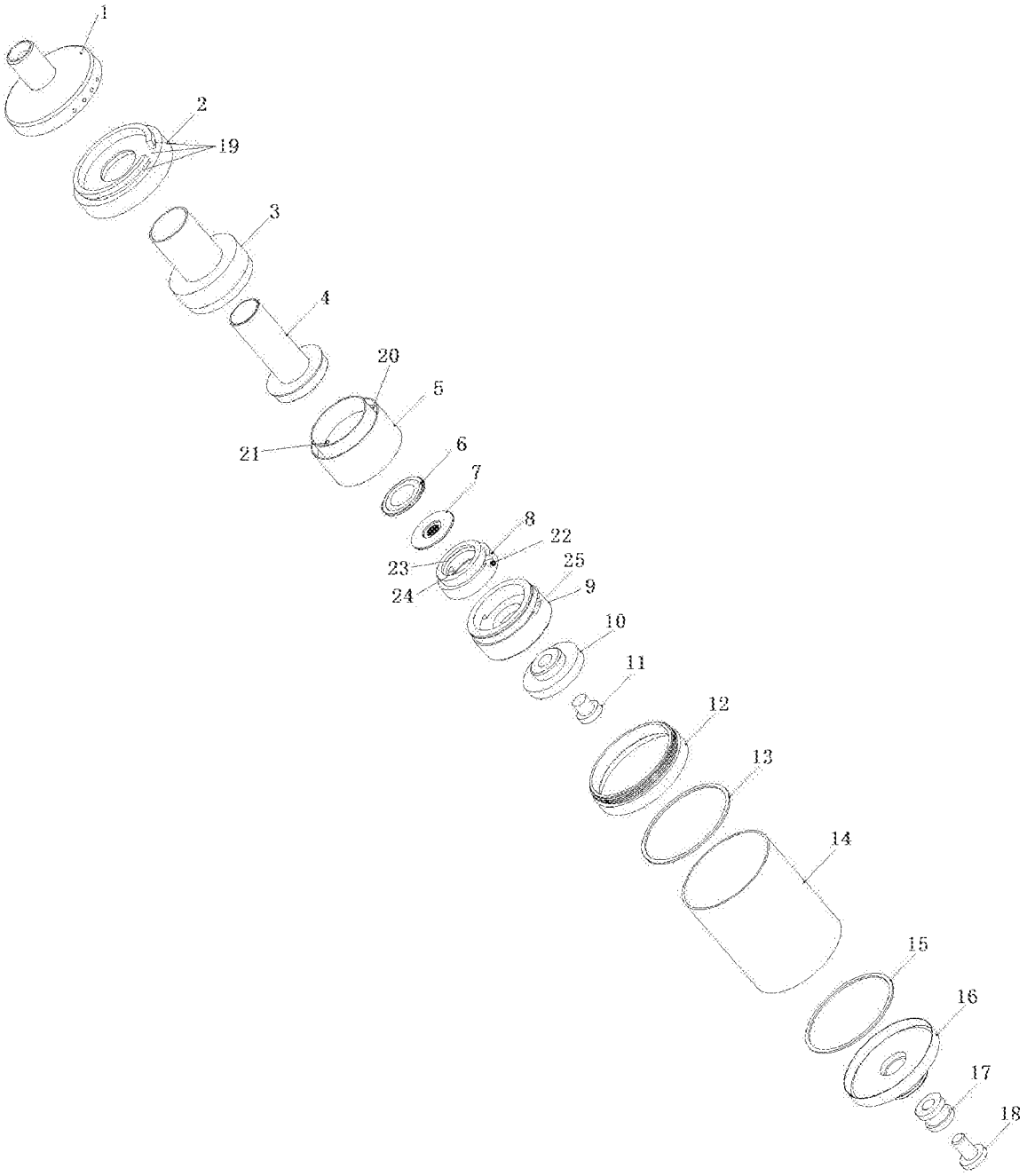
FIG. 7 is an explosive schematic diagram of embodiment 2 of the present invention.
Figure 8:
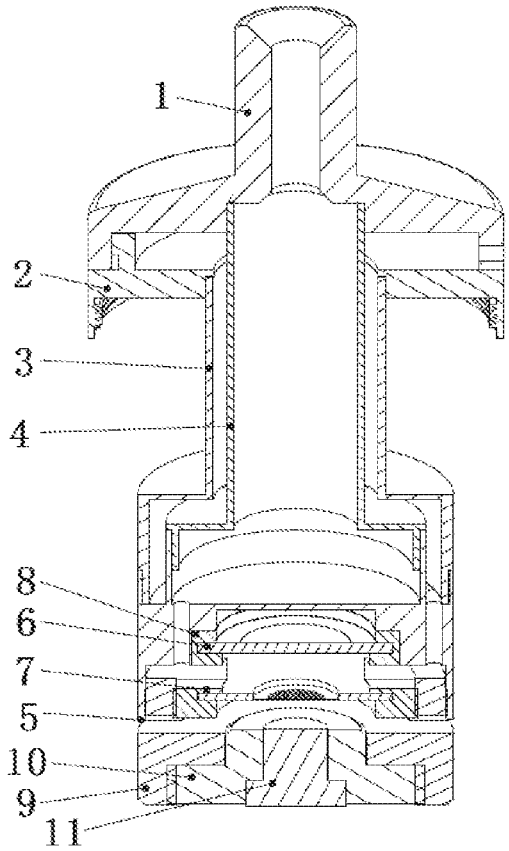
FIG. 8 is a structural schematic diagram of an atomization core in FIG. 7.
Figure 9:
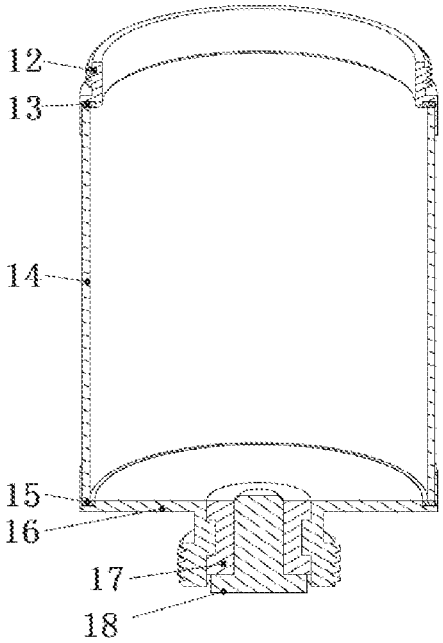
FIG. 9 is a structural schematic diagram of a tobacco tar cup component in FIG. 7.

According to the cotton-free ultrasonic atomizer, as shown in FIG. 7 to FIG. 9, the first atomization piece 7 is located below the second atomization piece 6, a tobacco tar inlet hole 25 is provided in the side wall of the outer electrode ring 9, the tobacco tar inlet hole 25 communicates with a lower end face of the first atomization piece 7, the rest structure is similar to that of embodiment 1, and thus will not be repeated redundantly.

Figure 10:
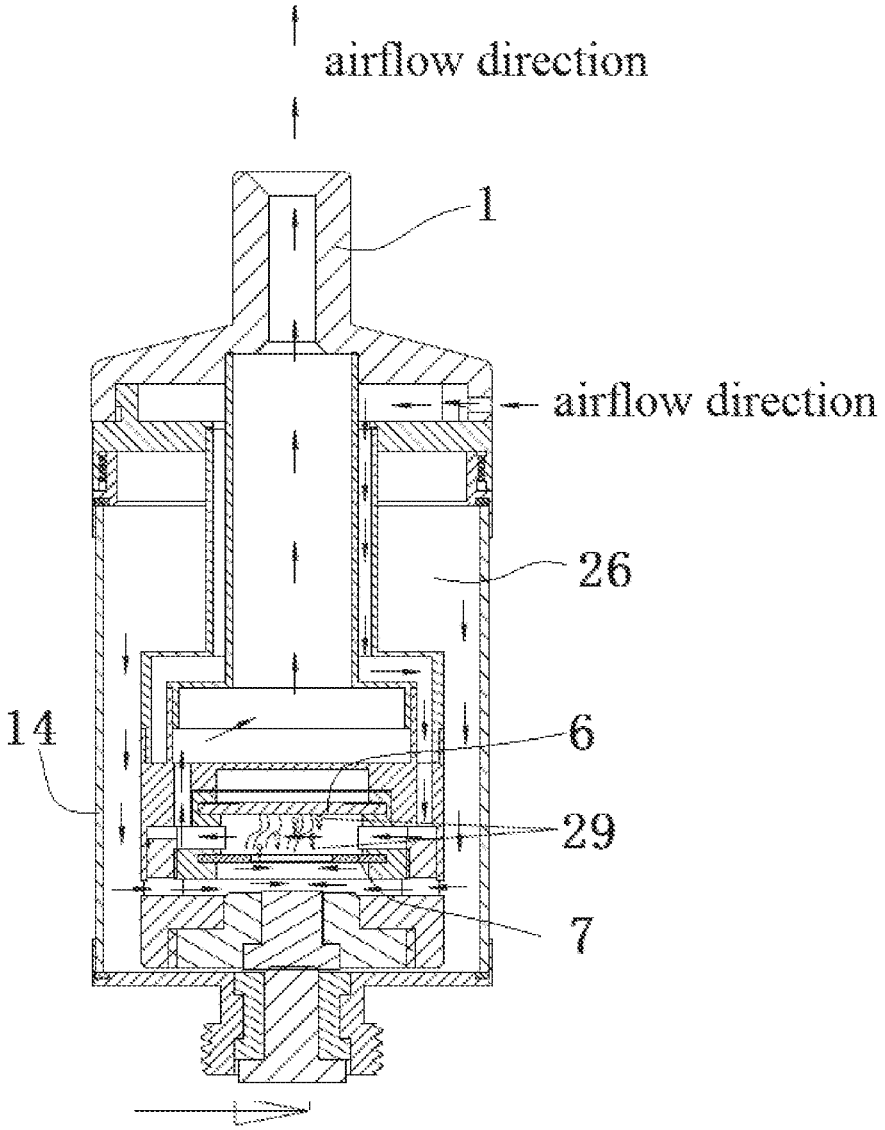
FIG. 10 is a sectional view along an inlet direction in embodiment 2.

As shown in FIG. 10, the second atomization piece is provided above the first atomization piece, after the second atomization piece atomizes the tobacco tar, if there still exist large-granule tobacco tar droplets, large-granule tobacco tar droplets 29 drop onto the surface of the first atomization piece and are ejected onto the second atomization piece again through vibration of the first atomization piece so as to be atomized again; and the small-granule smoke is taken away by the airflow for inhaling by the user.

The difference of the present embodiment with embodiment 1 lies in that:

1. the second ultrasonic atomization piece is provided above the first atomization piece, so that the small-granule smoke is taken away for inhaling by the user; and the large-granule tobacco tar droplets 29 drop onto the first atomization piece to be ejected onto the high-frequency ultrasonic atomization piece again for atomization, so as to improve the taste of the smoke.

2. The tobacco tar inlet hole 25 is provided in the outer electrode ring 9, so that the tobacco tar 26 is in direct contact with the surface of the first atomization piece 7.

Through the descriptions set forth in the above embodiments, it should be constructed that these embodiments are merely used for illustrating the present invention more clearly, rather than limiting the scope of the present invention, and all modifications in various equivalent forms made by those skilled in the art after reading the present invention shall be within the scope defined by the claims of the present application.

The invention claimed is:

1. A cotton-free ultrasonic atomizer, comprising a tobacco tar cup, an air inlet passage, a tobacco tar smoke outlet passage and an atomization component, wherein the atomization component comprises a first atomization piece and a second atomization piece; an atomization cavity is formed between the first atomization piece and the second atomization piece, and an ejection end of the first atomization piece aligns to an atomization surface of the second atomization piece; the first atomization piece communicates with a tobacco tar outlet of the tobacco tar cup, the air inlet passage communicates with the atomization cavity, and the atomization cavity communicates with the tobacco tar smoke outlet passage; and a hole is provided in the first atomization piece, and the second atomization piece is a solid atomization piece.

2. The cotton-free ultrasonic atomizer of claim 1, wherein the first atomization piece and the second atomization piece are both provided on an inner side of the tobacco tar cup.

3. The cotton-free ultrasonic atomizer of claim 1, wherein the first atomization piece and the second atomization piece are fixed in a hollow cavity of a silica gel base, and the atomization cavity is formed by enclosure of an inner wall surface of the silica gel base, the first atomization piece and the second atomization piece; and a vent groove hole which communicates with the air inlet passage and a smoke discharge hole which communicates with the tobacco tar smoke outlet passage are provided in a side wall of the silica gel base.

4. The cotton-free ultrasonic atomizer of claim 1, wherein an upper cover is fixed to a top of the tobacco tar cup through an annular upper base, and a suction nozzle is installed on an upper end of the upper cover; a first pipe located in the tobacco tar cup and a second pipe sheathed in the first pipe are installed on a lower end of the upper cover; a gap between the first pipe and the second pipe forms the air inlet passage which communicates with the atomization cavity; a vent hole groove which communicates with the air inlet passage is provided in a side wall of the upper cover; and an inner passage of the second pipe communicates with the suction nozzle to form the tobacco tar smoke outlet passage which communicates with the atomization cavity.

5. The cotton-free ultrasonic atomizer of claim 4, wherein the annular upper base is in threaded connection with the upper cover.

6. The cotton-free ultrasonic atomizer of claim 4, wherein a bottom end of the first pipe and a bottom end of the second pipe are both fixed to a fixing base, a silica gel base is fixed in the fixing base and the silica gel base fixes the first atomization piece and the second atomization piece, and an air inlet hole which communicates with the air inlet passage and a tobacco tar smoke discharge hole which communicates with the tobacco tar smoke outlet passage are provided in a side wall of the fixing base located in the tobacco tar cup.

7. The cotton-free ultrasonic atomizer of claim 6, wherein an outer electrode ring and an inner electrode ring installed on an inner side of the outer electrode ring through an insulating ring, are installed on a lower end of the fixing base; a lower base is fixed to a bottom end of the tobacco tar cup, a connection electrode ring is installed on an inner side of the lower base through a connection insulating ring, and the connection electrode ring is in electrical connection with the inner electrode ring; and the inner electrode ring is in electrical connection with the first atomization piece and the second atomization piece through conducting wires respectively.

8. The cotton-free ultrasonic atomizer of claim 7, wherein the first atomization piece is located above the second atomization piece, the fixing base comprises an inner cylinder and an outer cylinder, a tobacco tar inlet hole is provided in an upper part of the wall surface of the outer cylinder, and the tobacco tar inlet hole communicates with an upper end face of the first atomization piece.

9. The cotton-free ultrasonic atomizer of claim 7, wherein the first atomization piece is located below the second atomization piece, a tobacco tar inlet hole is provided in a side wall of the outer electrode ring, and the tobacco tar inlet hole communicates with a lower end face of the first atomization piece.

10. The cotton-free ultrasonic atomizer of claim 1, wherein an aperture of the first atomization piece is 40-100 μm.

11. The cotton-free ultrasonic atomizer of claim 10, wherein the aperture of the first atomization piece is 45-60 μm.

12. An Electronic cigarette, comprising a battery component and an ultrasonic atomizer, wherein the ultrasonic atomizer is a cotton-free ultrasonic atomizer comprising a tobacco tar cup, an air inlet passage, a tobacco tar smoke outlet passage and an atomization component, wherein the atomization component comprises a first atomization piece and a second atomization piece; an atomization cavity is formed between the first atomization piece and the second atomization piece, and an ejection end of the first atomization piece aligns to an atomization surface of the second atomization piece; the first atomization piece communicates with a tobacco tar outlet of the tobacco tar cup, the air inlet passage communicates with the atomization cavity, and the atomization cavity communicates with the tobacco tar smoke outlet passage; and a hole is provided in the first atomization piece, and the second atomization piece is a solid atomization piece, and the battery component respectively supplies power to the first atomization piece and the second atomization piece of the cotton-free ultrasonic atomizer.

13. The electronic cigarette of claim 12, wherein the first atomization piece and the second atomization piece are fixed in a hollow cavity of a silica gel base, and the atomization cavity is formed by enclosure of an inner wall surface of the silica gel base, the first atomization piece and the second atomization piece; and a vent groove hole which communicates with the air inlet passage and a smoke discharge hole which communicates with the tobacco tar smoke outlet passage are provided in a side wall of the silica gel base.

14. The electronic cigarette of claim 12, wherein an upper cover is fixed to a top of the tobacco tar cup through an annular upper base, and a suction nozzle is installed on an upper end of the upper cover; a first pipe located in the tobacco tar cup and a second pipe sheathed in the first pipe are installed on a lower end of the upper cover; a gap between the first pipe and the second pipe forms the air inlet passage which communicates with the atomization cavity; a vent hole groove which communicates with the air inlet passage is provided in a side wall of the upper cover; and an inner passage of the second pipe communicates with the suction nozzle to form the tobacco tar smoke outlet passage which communicates with the atomization cavity.

15. The electronic cigarette of claim 12, wherein a bottom end of the first pipe and a bottom end of the second pipe are both fixed to a fixing base, a silica gel base is fixed in the fixing base and the silica gel base fixes the first atomization piece and the second atomization piece, and an air inlet hole which communicates with the air inlet passage and a tobacco tar smoke discharge hole which communicates with the tobacco tar smoke outlet passage are provided in a side wall of the fixing base located in the tobacco tar cup.

16. The electronic cigarette of claim 15, wherein an outer electrode ring and an inner electrode ring installed on an inner side of the outer electrode ring through an insulating ring, are installed on a lower end of the fixing base; a lower base is fixed to a bottom end of the tobacco tar cup, a connection electrode ring is installed on an inner side of the lower base through a connection insulating ring, and the connection electrode ring is in electrical connection with the inner electrode ring; and the inner electrode ring is in electrical connection with the first atomization piece and the second atomization piece through conducting wires respectively.

17. The electronic cigarette of claim 16, wherein the first atomization piece is located above the second atomization piece, the fixing base comprises an inner cylinder and an outer cylinder, a tobacco tar inlet hole is provided in an upper part of the wall surface of the outer cylinder, and the tobacco tar inlet hole communicates with an upper end face of the first atomization piece.

18. The electronic cigarette of claim 16, wherein the first atomization piece is located below the second atomization piece, a tobacco tar inlet hole is provided in a side wall of the outer electrode ring, and the tobacco tar inlet hole communicates with a lower end face of the first atomization piece.

19. The electronic cigarette of claim 12, wherein an aperture of the first atomization piece is 40-100 μm.

20. The electronic cigarette of claim 19, wherein the aperture of the first atomization piece is 45-60 μm.

* * * * *